US008454266B2

(12) United States Patent
Buschmann et al.

(10) Patent No.: US 8,454,266 B2
(45) Date of Patent: Jun. 4, 2013

(54) METHOD FOR CONTROLLING THE PROCESS WHEN PRODUCING A PAVING MAT AND ROAD FINISHER

(75) Inventors: Martin Buschmann, Neustadt (DE); Ralf Weiser, Ladenburg (DE); Achim Eul, Mannheim (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 58 days.

(21) Appl. No.: 13/048,093

(22) Filed: Mar. 15, 2011

(65) Prior Publication Data

US 2011/0229263 A1 Sep. 22, 2011

(30) Foreign Application Priority Data

Mar. 18, 2010 (EP) ..... 10002897

(51) Int. Cl.
*E01C 19/42* (2006.01)
*E01C 19/00* (2006.01)

(52) U.S. Cl.
CPC ..... *E01C 19/002* (2013.01)
USPC ..... 404/72; 404/84.05

(58) Field of Classification Search
CPC ..... E01C 19/48
USPC ..... 404/84.05–84.8, 90–96, 101–120
See application file for complete search history.

(56) References Cited

U.S. PATENT DOCUMENTS

| | | | | |
|---|---|---|---|---|
| 4,828,428 | A * | 5/1989 | Anderson | 404/102 |
| 5,213,442 | A * | 5/1993 | Sovik | 404/102 |
| 5,356,238 | A * | 10/1994 | Musil et al. | 404/84.1 |
| 5,401,115 | A * | 3/1995 | Musil et al. | 404/72 |
| 6,238,135 | B1 * | 5/2001 | Rower | 404/84.5 |
| 6,749,364 | B1 * | 6/2004 | Baker et al. | 404/84.5 |
| 2002/0168226 | A1 * | 11/2002 | Feucht et al. | 404/84.1 |
| 2007/0098496 | A1 * | 5/2007 | Hall et al. | 404/94 |
| 2008/0038059 | A1 * | 2/2008 | Frelich | 404/75 |
| 2008/0260462 | A1 * | 10/2008 | Ackermann | 404/124 |
| 2009/0226255 | A1 * | 9/2009 | Lossow | 404/84.5 |
| 2011/0293369 | A9 * | 12/2011 | Commuri | 404/117 |

FOREIGN PATENT DOCUMENTS

| | | | |
|---|---|---|---|
| DE | 4040029 | C1 | 4/1992 |
| DE | 19836269 | C1 | 8/1999 |
| DE | 20010498 | U1 | 11/2000 |
| EP | 1258564 | A2 | 11/2002 |
| EP | 1179636 | B1 | 11/2005 |

* cited by examiner

*Primary Examiner* — Raymond W Addie
(74) *Attorney, Agent, or Firm* — Fish & Richardson P.C.

(57) ABSTRACT

A method for controlling the process laying a layer in a selectable paving thickness with a road finisher in which the laying process is automatically controlled in that a target value for the paving thickness is entered into an automatic closed-loop control system and communicates the actuating signals to such members and the signals. A road finisher has a computerized, either fully automatic or operator aided closed-loop control system for the direct control of the laying process with control of the paving thickness to a predetermined target value and for the optimization of the operating point of the pre-compaction system, which is connected to sensors at least for the acquisition of the setting angle of the screed, of the paving thickness and of the laying rate.

20 Claims, 3 Drawing Sheets

METHOD FOR CONTROLLING THE PROCESS WHEN PRODUCING A PAVING MAT AND ROAD FINISHER

FIELD OF THE INVENTION

The invention relates to a method of controlling the process of laying a layer of bituminous or concrete paving material in a selectable paving thickness on a level surface with a road finisher and a road finisher for practicing the method.

BACKGROUND OF THE INVENTION

German patent DE 198 36 269 A describes a method in which the tamper frequency is controlled according to a predetermined relationship dependent on the sampled setting angle of the screed. Since only the setting angle is considered as the influencing variable, the operator must adjust further influencing variables according to his own judgement, i.e. the operator cannot directly control the laying process, but rather must himself select certain machine parameters, whereby he is supported by the closed-loop control of the tamper frequency in dependence of the setting angle. It is the operator's responsibility to select the machine parameters to be entered such that he ultimately achieves the required result.

German patent DE 40 40 029 A discloses a method in which the tamper frequency is varied according to a predetermined relationship in dependence of the laying rate. Further machine parameters must be chosen and entered by the operator so that no direct control of the laying process is possible.

European patent EP 1 179 636 A discloses a road finisher, having a screed which has a tamper in the pre-compaction system. The tamper rotational speed is remotely adjustable in a closed-loop control circuit in order to vary the frequency of the tamper strokes. The effect of a change of the tamper rotational speed on the pre-compaction result is however only slight.

A road finisher disclosed in German patent DE 200 10 498 U1 has a tamper in the screed in the pre-compaction system which can be driven through an eccentric drive with fixed amplitude, i.e. a fixed tamper stroke, and optionally a vibration device for the smoothing plate. At the back of the smoothing plate a press strip is arranged, which lies permanently on the surface of the pre-compacted covering and is hydraulically subjected to non-zero crossing force pulses to produce high compaction. The press strip is not a constituent part of the pre-compaction system.

With an automatic tamper control system as disclosed in European patent EP 1 258 564 A the tamper frequency or the number of strokes of the tamper strip per unit of distance travelled can be set or automatically adapted depending on changes in the laying speed. The tamper stroke is not changed. The tamper frequency has a relatively slight influence on the pre-compaction result.

From the European patent application with prior seniority, application number 09 014 516.0, suggests at least automatically varying the tamper stroke, taking various laying parameters into account. Here too no direct process control is possible, because the setting angle of the screed or a change of the setting angle occurring during laying is not taken into account. The setting angle of the screed would namely be a very useful indicator of the operating state or operating point of the pre-compaction system, because a setting angle that is too flat or too steep inevitably results in problems with regard to the achievable compaction, flatness and structure of the covering.

Furthermore, in practice leveling systems or even automatic leveling systems for road finishers are known which typically include closed-loop control circuits and actuate the leveling cylinder of the road finisher. At least one sensor samples a reference and supplies a measurement which is compared in the system with a target value. An operator enters the target value. The system then generates the actuating signal for the leveling cylinder. The paving thickness is controlled in this way, whereby other essential machine parameters for the paving thickness, such as the tamper stroke, tamper frequency and the laying rate, are not considered. The machine parameters must be optimally chosen and implemented by the operator. The machine parameters are not process target values, which implies that the operator cannot set that which is to be strived for, namely a certain paving thickness. The operator so to speak controls the machine to ultimately achieve the required result. A direct process control is not possible with this method.

OBJECT OF THE INVENTION

The object of the invention is to specify a method for controlling the process of laying a layer of paving material in a selectable pavement thickness on a level surface and a road finisher for implementing the method, which facilitates the direct control of the laying process without burdening the operator with inexpediently high responsibility in the selection of the correct machine parameters.

SUMMARY OF THE INVENTION

The set object is solved with the method of the present invention and with the road finisher described herein.

With the method of the present invention the laying process is directly and largely automatically controlled, because the closed-loop control system knows and takes into account all the significant process target values and primarily also takes into account the setting angle of the screed as an additional control input variable to control the paving thickness to the target value and furthermore to optimize the operating point of the pre-compaction system such that the target paving thickness is achieved with optimum pre-compaction, optimum flatness and optimum structure of the paving with minimum wear of the operational components and with minimum energy consumption. The setting angle, as a control input variable which is continuously acquired and taken into account, can be processed by the control system as a significant indicator for the operating state of the pre-compaction system in order to prevent a setting angle arising in the process control which is too flat or too steep and would negatively influence the achieved compaction, flatness and structure. The control system processes the information on the actual laying rate and about the actual setting angle of the screed so that the manipulated variables are generated and implemented with regard to the target value of the paving thickness, whereby the actual setting angle is in each case largely held at the preselected target setting angle. An actuating member for the tamper stroke produced through an eccentric drive is a remotely controllable gear train for the adjustment of the eccentricity according to the method during the laying process which is responsible for the amplitude of the tamper stroke. The gear train can be mechanically, hydraulically, or electrically adjusted.

The road finisher can also be driven for the laying process with a high level of convenience and without fundamental knowledge of the relationships of the various laying parameters by a relatively untrained operator, whereby, due to the direct process control, the layer thickness is controlled to the target value and the operating point of the pre-compaction system is also optimized. An actuating member for the tamper stroke produced through an eccentric drive is a remotely controllable gear train for the adjustment of the eccentricity according to the method during the laying process which is responsible for the amplitude of the tamper stroke. The gear train can be mechanically, hydraulically, or electrically adjusted. By using the road finisher, optimum pre-compaction with optimum flatness and optimum structure of the paving can be produced with a controlled paving thickness, whereby minimum wear on the operational components can be achieved with the process using the minimum energy consumption.

With an expedient variant of the method actuating signals are generated during the process control by the closed-loop control system at least for the tamper stroke or the tamper frequency or even for the tamper stroke and the tamper frequency, which are then implemented by the appropriate actuating members such that, taking the setting angle into account as a control input variable, the tamper takes a major part in uniformly achieving the correct paving thickness with optimum pre-compaction, flatness and structure of the paving.

In a further variant of the method additional actuating signals for actuating members of the leveling cylinders and/or of the lifting cylinders are generated and implemented in order, for example, to assist with the maintenance of the target value of the setting angle of the pre-compaction system by height adjustment of the anchorage points of the towing arms and/or by relief of the screed provided by the lifting cylinder.

With an expedient variant of the method the acquired actual laying rate is communicated as manipulated-variable information for processing by the closed-loop control system. A change of the laying rate causes an automatic change of the actuating signals for the actuating members to keep both essentially constant, namely the paving thickness and the setting angle.

In an alternative variant of the method the laying rate is selected or preselected by an operator and the actual laying rate is communicated as disturbance variable information for processing by the closed-loop control system. In this case the laying rate is made available to the control system for processing, but can be freely selected by an operator. This is important, because in practice the laying rate should be selected such that the desired working rate (mass throughput of paving material, processed area) can be matched to the relevant conditions or certain specifications. Therefore it is expedient, despite the automatic closed-loop or open-loop control of the laying process, to offer the operator influence over at least the laying rate.

In a further variant of the method the closed-loop control system generates a laying rate recommendation with the direct process control for the operator in the form of a speed value or speed range which the operator implements or can implement with regard to the optimum performance in the laying process.

Expediently at least, some or all acquired information is processed for direct process control in the closed-loop control system as control input variables to at least generate the actuating signals for the tamper stroke or the tamper frequency or the tamper stroke and the tamper frequency. Accompanying this, actuating signals for the leveling cylinders or the lifting cylinders can also be generated and implemented to allow the process control to be carried out essentially only by the closed-loop control system and to relieve the operator.

In an expedient embodiment of the road finisher actuating members at least for setting the tamper stroke or the tamper stroke and the tamper frequency based on actuating signals generated by the closed-loop control system are connected to the control system. When implementing these actuating signals and with consideration of the laying rate and primarily also the setting angle, the pre-compaction output of the pre-compaction system is optimized to achieve the target paving thickness and so as not to significantly vary the setting angle. A certain pre-compaction output, depending on the tamper stroke and tamper frequency would namely with a reduction of the laying rate lead to the screed rising and a reduction in the setting angle, whereas an increase of the laying rate would result in the opposite result, namely in the lowering of the screed and an increase in the setting angle, each with undesired secondary effects.

In order to eliminate or minimize secondary effects of this nature during the process control it may be expedient in a further embodiment to connect additional actuating members to the closed-loop control system for adjusting the leveling cylinder and/or the lifting cylinder based on actuating signals generated by the control system in order to avoid or immediately counteract unwanted changes in the setting angle.

In an expedient embodiment of the road finisher the closed-loop control system has either at least one, preferably a plurality of parallel connected single-variable controllers, for example three single-variable controllers, of which, for example, one controls the tamper frequency taking the laying rate into account, another one controls the tamper stroke taking the setting angle into account and a further one actuates the leveling cylinder taking the paving thickness into account or at least a multi-variable controller, which for example processes a plurality of control input variables and generates a plurality of actuating signals. For example, the multi-variable controller processes the control input variables, laying rate and setting angle, and generates the actuating signals for changing the tamper frequency and the tamper stroke. The single-variable controller on the other hand processes the information on the paving thickness and generates as required actuating signals for the leveling cylinders and/or the lifting cylinders.

In an expedient embodiment the closed-loop control system is equipped with a display in which, among other features, a laying rate recommendation can be displayed for the operator, for example, in case the control system detects in a self-learning manner that the laying rate is too fast or too slow or needs changing due to a change in another control input variable.

In the closed-loop control system classical PID controllers, adaptive controllers, and also fuzzy-logic controllers, neural network controllers or other controllers can be used.

Furthermore, it may be expedient to provide in the closed-loop control system at least one predetermined characteristic or family of characteristics and/or a controller based on a characteristic or family of characteristics for manipulated variables which are to correlate to one another.

An actuating member for the tamper frequency produced by a hydraulic drive can be a solenoid-operated valve, preferably even a proportional flow control valve, to adjust the tamper frequency via the rotational speed produced by the hydraulic drive.

An actuating member for the setting angle of the screed can at least be a solenoid-operated valve for the leveling cylinders, whereby the momentary actual position of the leveling cylinders can be fed back to the closed-loop control system.

An actuating member, preferably for adjusting a certain screed relief, can be a solenoid-operated valve for the hydraulic lifting cylinder.

With a paving thickness which varies transversely to the working direction the direct process control can also consider at least varying the tamper stroke or the tamper stroke and the tamper frequency over the pave width of the screed in order to produce the same compaction effect transverse to the working direction.

DESCRIPTION OF THE DRAWINGS

Embodiments of the object of the invention are described based on the drawings. The following are shown.

DETAILED DESCRIPTION

Figure 1:
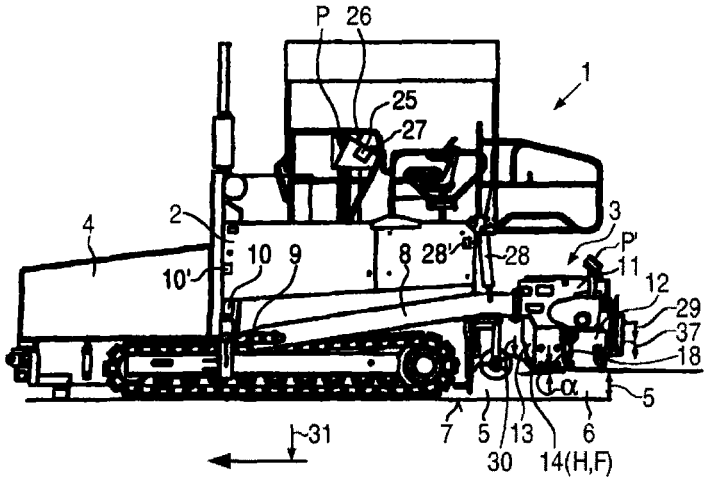
FIG. 1 a schematic side elevation of a road finisher carrying out a laying process, FIG. 2 a detail view of a screed of the road finisher in FIG. 1, FIG. 3 a schematic illustration of a closed-loop control system of the road finisher in FIG. 1, FIG. 4 another embodiment of the closed-loop control system in a schematic illustration, and FIG. 5 another embodiment of the closed-loop control system in a schematic illustration.

FIG. 1 shows a self-propelled road finisher 1 carrying out a laying process, i.e. during the laying of a layer 6 of bituminous or concrete paving material 5 on a level surface 7 with a paving thickness S and a laying rate V relative to the level formation 7, whereby the layer 6 is at least pre-compacted by a pre-compaction system 13 of a screed 3 and laid flat.

The core of the road finisher 1 is a computerized, either fully automatic or operator assisted closed-loop control system 25, for example in an operating console P in a driver's cab and/or in an external control position P' on the screed 3. The closed-loop control system 25 can be used by an operator such that the operator can directly control the laying process and essentially needs to select no laying parameters himself and/or change them when laying.

On the chassis 2 of the road finisher 1 a bunker 4 is arranged at the front, from which a longitudinal conveyor system, which is not highlighted, deposits paving material 5 behind the chassis 2 onto the level surface 7 where it is distributed by a transverse spreader device before the screed 3 forms the paving 6 from it. The level surface is usually the ground surface on which the paving layer is laid. However, the surface can be a pre-worked ground surface or the pre-treated top surface of an old paving layer. The screed 3 is mounted on towing spars 8 which are anchored to the anchorage points 9 on the chassis 2 such that the screed 3 is towed floating on the paving material 5. The anchorage points 9 can be adjusted in height with leveling cylinders, for example, via actuating members 10' (hydraulic valves or similar components) and influence a setting angle $\alpha$ of the screed 3. The setting angle $\alpha$ should be positive, but with an optimum magnitude, i.e. not too flat and too steep, and is maintained at an optimum magnitude by the closed-loop control system 25. In addition lifting cylinders 28 are anchored on the chassis 2, which engage the towing spars 8 and are used, for example, to lift and position the screed 3 during a transport run, or to relieve the screed when laying or optionally to increase the contact pressure of the screed 3.

The screed 3 comprises, for example, a basic screed 11 and travelling extending screeds 12, each with a pre-compaction system 13, for example at least a tamper 14 and optionally a vibration device, which is not illustrated, for a smoothing plate 18 on the ground side. As an option the screed 3 can be equipped with a high compaction device which is not shown. The tamper 14 (see FIG. 2) can, for example, be operated by means of an eccentric drive with selectable stroke H and selectable frequency F.

The external control position P' on the screed 3 can be equipped similar to the operating console P. A speed selector 26 is provided in the operating console P for adjusting the laying rate V. The speed selector 26 can be optionally adjusted by the closed-loop control system 25 through an actuating member which is not shown, in order to change the laying rate V. The actual laying rate V is acquired by at least one symbolically indicated sensor 31 and communicated to the closed-loop control system 25.

The sensor 31 can be positioned in the road finisher, for example, in the operating console P or on a propulsion drive or sample a reference on the level surface 7. In the operating console P or with the closed-loop control system 25 an input section 27 can be provided for entering and/or displaying parameters. The cylinders 28 are assigned at least one actuating member 28', for example a solenoid-operated hydraulic valve. Furthermore, the road finisher 1 can be equipped with at least one sensor 30, which detects the temperature, density or consistency of the paving material, for example directly in front of the screed 3 and optionally communicates it as information to the closed-loop control system 25. This laying parameter could alternatively be entered by the operator. For example, on the screed 3 at least one sensor 29 is provided, which acquires the setting angle $\alpha$ of the screed 3, e.g. relative to the level formation 7. This sensor 29 could sample the setting angle $\alpha$ also on the towing spars 8. A plurality of sensors 29 could be provided over the pave width. Furthermore, a sensor 37 for sampling the paving thickness S can be provided, which for example, samples the level surface 7 or a reference line which is not illustrated.

Actuating members for adjusting the tamper stroke H or the tamper frequency F are also provided in the road finisher 1 or in the screed 3 in order to implement the actuating signals generated by the closed-loop control system 25.

Figure 2:
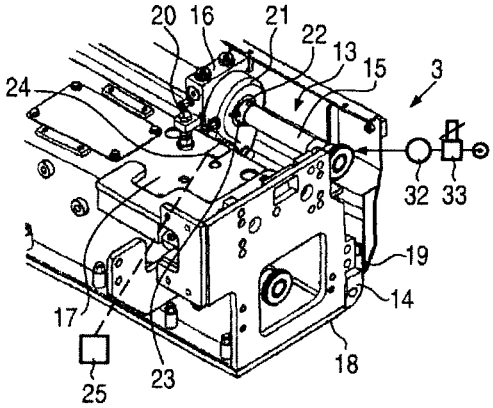

For example, FIG. 2 shows a partially exposed section of the screed 3 with the pre-compaction system 13 and the tamper 14. The tamper 14 can be screened on the front of the screed 3 by a cover 19 and be moved vertically between the cover 19 and the front edge of the smoothing plate 18. On a frame 17 bearing the smoothing plate 18 on its underside a pivot block 16 is mounted, the relative height of which is, for example, adjustable by means of an adjustment screw 20 such that the tamper 14 has a certain relative position to the smoothing plate 18 at the bottom dead centre of each stroke. In the pivot block 16 (a plurality of pivot blocks 16 can be mounted over the length of the frame 17) an eccentric shaft 15 is pivotably supported, which in each case has an eccentric section 22 with a certain eccentricity. The eccentric section 22 engages a connecting rod 21 which joins the eccentric shaft 15 to the tamper 14. On the eccentric section 22 an eccentric bushing 23 is coupled rotationally fixed to the eccentric section 22 through a gear train 24 forming the actuating member for the tamper stroke H. The gear train 24 is supported on the frame 17. The eccentric bushing 23 is pivotably supported in the connecting rod 21. The eccentric bushing 23 can be rotated relative to the eccentric section 22 by means of the gear train 24 and coupled to the eccentric shaft 15 in the corresponding set rotary position. The relative rotation of the eccentric bushing 23 with respect to the eccentric section 22 causes an adjustment to the stroke which is transferred by the connecting rod to the tamper 14. The adjustment of the tamper stroke H occurs automatically via the closed-loop control system 25.

The eccentric shaft 15 is, for example, rotationally driven by a hydraulic motor 32. The speed determines the tamper frequency F. A solenoid-operated valve, e.g. a proportional flow control valve to which actuating signals from the closed-loop control system 25 are applied, can be used as the actuating member 33 for the hydraulic motor 32. The representation of the gear train in FIG. 2 should only be taken as schematic, because the gear train 24 as an adjustment device of course indirectly affects the eccentric bushing 23 through the eccentric shaft 15 due to the rotation of the eccentric shaft 15. For the gear train 24 as an actuating member for setting the tamper stroke H various embodiments are conceivable, of which FIG. 2 only illustrates a non-restricting embodiment.

The closed-loop control system 25 is designed such that it directly controls the laying process in an open or closed-loop manner and an operator only needs to enter process target values such as a certain paving thickness S, for example on the input section 27 and then the laying process is controlled without further operator intervention. The road finisher 1 can move with a predetermined or programmed laying rate V, whereby optionally an operator can select the laying rate V and/or the closed-loop control system 25 offers the operator, for example in a display not highlighted, a laying rate recommendation which the control system 25 specifies, for example, with regard to the process target or an optimum performance (mass throughput, processed area), and which can then be implemented by the operator. Since external influences can cause changes in the laying rate V compared to the specification, e.g. ascending or descending gradients, running resistance, and similar effects, the sensor 29 however samples the actual laying rate and communicates it to the closed-loop control system 25, so that the process control is not detrimentally affected by a laying rate change deviating from the specification. This also applies similarly to the actual setting angle α, which is initially specified by the height setting of the anchor points 9 and is assigned to the desired paving thickness S, but which can vary during the laying process due to external influences and therefore, for example, is acquired within the working width by the at least one sensor 37 and is communicated to the closed-loop control system 25.

Alternatively, the laying rate V could be taken into account as a disturbance variable, i.e. the laying rate V is made available to the closed-loop control system 25 for processing, for example, by the information provided by the at least one sensor 29 and/or by the speed selector 26 which can however be freely selected by an operator. This is of significance, because the laying rate is used to obtain the optimum performance of the road finisher during the laying process (mass throughput, processed area).

During the laying process the closed-loop control system 25 controls the paving thickness S to a specified target value. Furthermore, the closed-loop control system 25 optimizes the operating point of the pre-compaction system 13 with the tamper 14 such that the target value of the layer thickness S is achieved with optimum pre-compaction, optimum flatness and optimum structure of the layer 6 with minimum wear, for example in the pre-compaction system 13 and also minimum energy consumption. The closed-loop control system 25 brings about this positive effect also primarily in that the setting angle α of the screed is determined and processed as an additional control input variable. This is because the setting angle α is an excellent indicator for assessing the operating state of the pre-compaction system 13. For example, namely a setting angle α which is too flat or too steep would produce problems with the compaction, flatness and in the structure.

Figure 3:
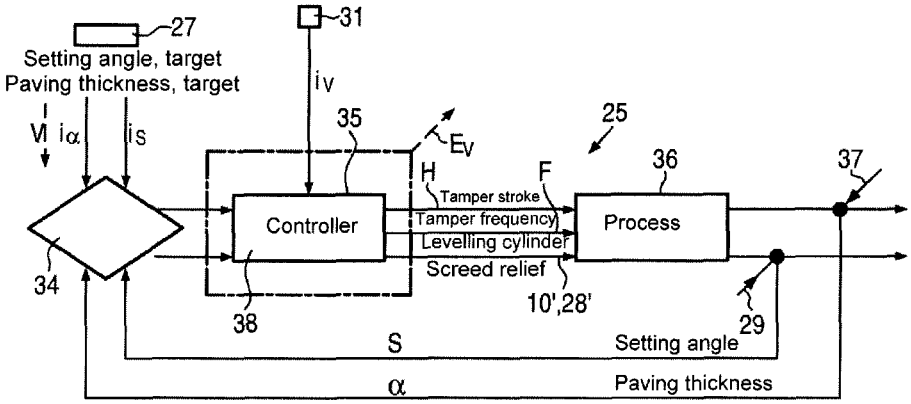
Figure 4:
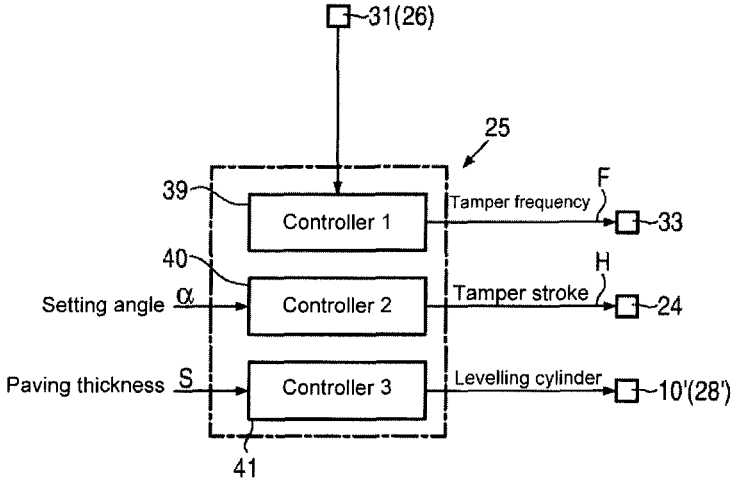
Figure 5:
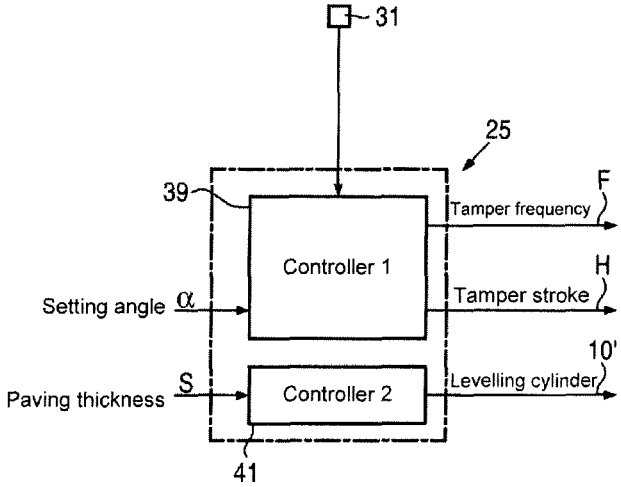

FIGS. 3 to 5 show a selection of embodiments of the closed-loop control system 25. This selection should be taken as not restrictive.

In FIG. 3 the closed-loop control system 25 has a controller 35 which is designed as a multi-variable controller 38 and to which a comparator section 34 is assigned. The comparator section 34 receives the specifications iα and is for the setting angle α and the paving thickness S, e.g. as target values. The section shown in broken lines indicates that also the laying rate V, such as for example entered by an operator, can be taken into account here. This input of the laying rate V indicated by broken lines can be selected by an operator based on a laying rate recommendation Ev generated by the closed-loop control system 25 and shown in a display which is not illustrated, if the control system 25 finds that the original specified laying rate V is not expedient. The values acquired by means of the sensors 29, 37 are also communicated to the comparator section 34 as information on the paving thickness S and the setting angle α. If deviations between the specification and the actual values occur, the comparator section 34 feeds the controller 35 to which the actual laying rate acquired by the at least one sensor 31 is also passed as information iv. From the information passed, the controller 35 generates the actuating signals H for the tamper stroke and/or F for the tamper frequency and, optionally, also at least one actuating signal either for the leveling cylinders 10 (the actuating member 10') and/or the lifting cylinders 28 (actuating member 28'). Through the implementation of these actuating signals the laying process 36 is controlled so that the desired paving thickness S is achieved and also the setting angle α is maintained, whereby here feedback paths to the comparator section 34 are indicated.

In the embodiment in FIG. 4 the closed-loop control system 25 is here formed with three parallel single-variable controllers 39, 40, 41. The single-variable controller 39 receives, for example from the sensor 31, the laying rate information (optionally also from the speed selector 26 or superimposed on its setting) and generates the actuating signal for the actuating member 33 of the tamper frequency F. The single-variable controller 40 receives the information about the actual setting angle α and generates the actuating signal for the actuating member (gear train 24) for setting the tamper stroke H. The single-variable controller 41 receives the information on the paving thickness S (the target value or a control input variable derived from the target value and the actual value) and generates actuating signals for the actuating member 10' and/or 28' for the leveling cylinders 10 or the lifting cylinders 28.

In the embodiment in FIG. 5 the closed-loop control system 25 comprises a multi-variable controller 38 and at least one single-variable controller 41. The multi-variable controller 38 receives the laying rate information from the at least one sensor 31 and also the information regarding the setting angle α and generates actuating signals for the tamper frequency and for the tamper stroke H. The single-variable controller 41 receives the information on the paving thickness S and, if expedient, generates actuating signals, for example, for the actuating members 10' or/and 28'.

The controllers in the embodiments 3 to 5 can be classical proportional-integral-derivative (PID) controllers, or adaptive controllers, or fuzzy-logic controllers or neural network controllers or other computerized controllers. Furthermore, the controllers or the closed-loop control system can include characteristics or families of characteristics or be represented as an open-loop control based on characteristics/families of characteristics. The characteristics or families of characteristics relate, for example, to mutually correlating manipulated variables, e.g. F or H, F and H, F or H and α, F or H and 10', 28' or similar variables.

What is claimed is:

1. Method of controlling the process of laying a paving material layer in a selectable paving thickness on a level surface with a road finisher having a floating screed towed by towing spars and self-propelled at a laying rate, the screed having a pre-compaction system with at least one tamper having an eccentric drive is operable with a selectable stroke and a selectable frequency, which comprises entering a target value for the paving thickness into an automatic closed-loop control system, acquiring information on an actual setting angle of the screed, the actual paving thickness and the laying rate of the road finisher, communicating the acquired setting angle, paving thickness and laying rate information to the control system, generating actual signals in the control system based at least on the information acquired on the actual setting-angle, paving thickness and laying rate for actuating members including at least for the actuating member for adjusting the tamper stroke, communicating the actuating signals to one or more of the actuating members, the actuating signals being automatically implemented by the actuating members to control the actual paving thickness to a target value and to optimise an operating point of the pre-compaction system, and implementing at least one of such actuating signals with a remotely operable gear train, the gear train adjusting the tamper stroke during the laying process by adjusting the eccentricity produced by the eccentric drive to an optimised operating point of the pre-compaction system.

2. Method according to claim 1, which comprises generating additional actuating signals for actuating members of the leveling cylinders and/or actuating members of the lifting cylinders.

3. Method according to claim 1, which comprises communicating the acquired actual laying rate to the closed-loop control system as manipulated variable information for processing.

4. Method according to claim 1, which comprises having an operator of the road finisher select the laying rate and communicating either the selected laying rate or the acquired actual laying rate to the closed-loop control system as disturbance variable information for processing.

5. Method according to claim 1 which comprises generating a laying rate recommendation for an operator of the road finisher in the form of a speed value or a speed range with the closed loop control system and having the operator implement the laying rate recommendation.

6. Method according to claim 1 which comprises processing a portion of the acquired information in the closed-loop control system as control input variables.

7. The method of claim 1 wherein the paving material is concrete or bituminous material.

8. A road finisher comprising a screed fitted to stowing spars for laying paving material layer in a paving thickness on a level surface, the screed having a pre-compaction system with at least one tamper operable by an eccentric drive and having a selectable stroke determined by an eccentricity produced by the eccentric drive and a selectable stroke frequency, at least two anchor points on the towing spars that are adjustable with levelling cylinders, lifting cylinders for adjusting the height of the towing spars with, a computerised, fully automatic or operator aided closed-loop system for controlling the paving thickness to a specified target value for controlling the laying process and for optimising the operating point of the pre-compaction system, and including sensors for the acquisition of at least a setting angle of the screed, the paving thickness and a laying rate connected to the control system, an actuating member for adjusting at least the tamper stroke based on actuating signals generated by the control system, the actuating member being connected to the control system and comprising a remotely operable gear train for automatically adjusting during the paving process the eccentricity produced by the eccentric drive for the tamper stroke of the tamper to correspond with the optimised operating point of the pre-compaction system.

9. Road finisher according to claim 8, which comprises an actuating member connected to the closed-loop control system for adjusting the tamper frequency based on actuating signals generated by the control system during the laying process.

10. Road finisher according to claim 8, which comprises additional actuating members connected to the closed-loop control system for adjusting the leveling cylinders and/or the lifting cylinders in response to actuating signals generated by the control system.

11. Road finisher according to claim 8, wherein the closed-loop control system has at least one single-variable controller and/or at least one multi-variable controller.

12. Road finisher according to claim 11 wherein the closed loop control system has three parallel connected single variable controllers.

13. Road finisher according to claim 12, wherein the respective single-variable controllers or the multi-variable controller is a member selected from the group consisting of a PID controller, an adaptive controller, a fuzzy-logic controller or a neural network controller.

14. Road finisher according to claim 8, wherein the closed-loop control system has at least one predetermined characteristic or family of characteristics and/or a control based on a characteristic or family of characteristics for mutually correlated manipulated variables.

15. Road finisher according to claim 8, wherein the actuating member for the tamper frequency produced by a hydraulic drive is a solenoid-operated proportional flow control valve.

16. Method for controlling the process of depositing a layer of paving material in a target thickness on a level surface with a road finisher having a screed and a tamper having an eccentric drive which comprises entering a target value for the paving thickness into an automatic closed-loop control system, acquiring an actual setting angle of the screed, the actual pavement thickness and the rate of laying the paving material as information with a plurality of sensors mounted on the road finisher, transferring the acquired information to the control system, generating actuating signals in the control system for actuating members of the road finisher in response to at least the acquired information, the actuating members including an actuating member for adjusting a tamper stroke determining eccentricity produced by the eccentric drive, and communicating the actual signals generated by the control system to actuate at least the actuating member for adjusting the tamper stroke during the paving process and automatically bringing the paving thickness to the target thickness.

17. A road finisher for depositing a layer of paving material to a target thickness on a level surface comprising a screed body including a pre-compaction system having a tamper that is operable with selectable stroke and selectable frequency and an eccentric drive, for providing an eccentric stroke to the tamper, height adjustable towing spars having anchor points on the screed body, the anchor points being operably linked to leveling cylinders, a closed loop control system for controlling the paving thickness to correspond to the target thickness, the control system including sensors for detecting at least the paving thickness, the laying rate and the setting angle of the screed, and being operably connected to the sensors, an actuating member connected to the closed loop control system for adjusting at least stroke of the tamper during deposition of the paving material in response to actuating signals received from the closed loop control system, and a remotely operable gear train for adjusting the eccentricity of the tamper stroke of the tamper during the pavement deposition.

18. The road finisher of claim 17 further comprising a lifting cylinder for adjusting the height of the towing spars.

19. The method of claim 17 which comprises communicating actuating signals to adjust a setting angle of the screed, the frequency of the tamper and the stroke of the tamper.

20. The method of claim 17 wherein the level surface is a pre-existing layer of paving material.

* * * * *